US006332407B1

(12) United States Patent
Vardaro

(10) Patent No.: US 6,332,407 B1
(45) Date of Patent: Dec. 25, 2001

(54) COMPUTER WORK STATION

(75) Inventor: Antonio Vardaro, Montréal (CA)

(73) Assignee: Artítalia Inc., Montreal (CA)

( * ) Notice: Subject to any disclaimer, the term of this patent is extended or adjusted under 35 U.S.C. 154(b) by 0 days.

(21) Appl. No.: 09/548,753

(22) Filed: Apr. 13, 2000

(51) Int. Cl.[7] ..... A47B 37/00
(52) U.S. Cl. ..... 108/50.01; 100/92
(58) Field of Search ..... 108/50.01, 50.02, 108/1, 3, 9, 92, 96; 248/242, 397, 277.12

(56) References Cited

U.S. PATENT DOCUMENTS

| | | | | |
|---|---|---|---|---|
| 2,584,310 | * | 2/1952 | Weinberg | 108/9 X |
| 2,872,252 | * | 2/1959 | Konkle | 108/147.21 X |
| 4,469,029 | | 9/1984 | Ramond . | |
| 4,550,666 | | 11/1985 | Svoboda . | |
| 4,567,835 | * | 2/1986 | Reese et al. | 108/92 X |
| 4,679,510 | | 7/1987 | Veyhl et al. . | |
| 5,041,770 | | 8/1991 | Seiler et al. . | |
| 5,044,284 | | 9/1991 | Gross . | |
| 5,088,420 | * | 2/1992 | Russell | 108/96 X |
| 5,257,767 | | 11/1993 | McConnell . | |
| 5,357,873 | * | 10/1994 | Hilton | 108/50.01 |
| 5,398,622 | | 3/1995 | Lubinskas et al. . | |
| 5,513,579 | | 5/1996 | Allan . | |
| 5,568,773 | | 10/1996 | Hung . | |
| 5,653,413 | | 8/1997 | Fink . | |
| 5,692,712 | | 12/1997 | Weinschenk, Jr. et al. . | |
| 5,779,305 | | 7/1998 | Hocking . | |
| 5,836,560 | | 11/1998 | Kaplan et al. . | |
| 5,839,373 | | 11/1998 | Lin . | |
| 5,862,761 | * | 1/1999 | Moore | 108/50.01 X |
| 5,868,079 | * | 2/1999 | Charny | 108/50.01 X |
| 5,901,933 | | 5/1999 | Lin . | |
| 5,961,231 | | 10/1999 | Ambrose . | |
| 5,967,631 | * | 10/1999 | Ko | 108/92 X |
| 6,128,579 | * | 2/2000 | Chang | 108/50.01 |
| 6,158,357 | * | 12/2000 | Shih | 108/50.01 |

FOREIGN PATENT DOCUMENTS

| | | |
|---|---|---|
| 2178930 | 6/1995 | (CA) . |
| 2140609 | 7/1996 | (CA) . |
| 2268785 | 10/1996 | (CA) . |
| WO 95/30357 | 11/1995 | (WO) . |
| WO 98/16144 | 10/1996 | (WO) . |

* cited by examiner

*Primary Examiner*—Jose V. Chen
(74) *Attorney, Agent, or Firm*—Goudreau Gage Dubuc

(57) ABSTRACT

A computer work station provided with separate shelves to support a monitor, a keyboard, a mouse pad, a printer or the like is described herein. The monitor shelf is mounted to the main body via a pair of parallel arms allowing this shelf to be moved towards or away from the user while maintaining the generally horizontal attitude of the shelf. A locking mechanism is provided to maintain the desired monitor shelf position.

13 Claims, 4 Drawing Sheets

COMPUTER WORK STATION

FIELD OF THE INVENTION

The present invention relates to computer work stations. More specifically, the present invention relates to a computer work station provided with separate adjustable shelves for different computer peripherals.

BACKGROUND OF THE INVENTION

Many computer stands may be found in the prior art. However, conventional computer stands usually lack adjustability to allow the user to place the various peripheral associated with a computer at adequate positions.

OBJECTS OF THE INVENTION

An object of the present invention is therefore to provide an improved and flexible computer work station that may also be used as a play station.

SUMMARY OF THE INVENTION

More specifically, in accordance with the present invention, there is provided a computer work station comprising:

a main support;

first and second adjustable support elements mounted to the main support; each first and second adjustable support element including a body, a pair of parallel arms having proximate ends pivotally mounted to the body and distal ends, and a third arm having a proximate end pivotally mounted to the body and a distal end;

a monitor shelf pivotally mounted to the distal ends of the pair of parallel arms; and a keyboard shelf pivotally mounted to the distal end of the third arm.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

Figure 1:
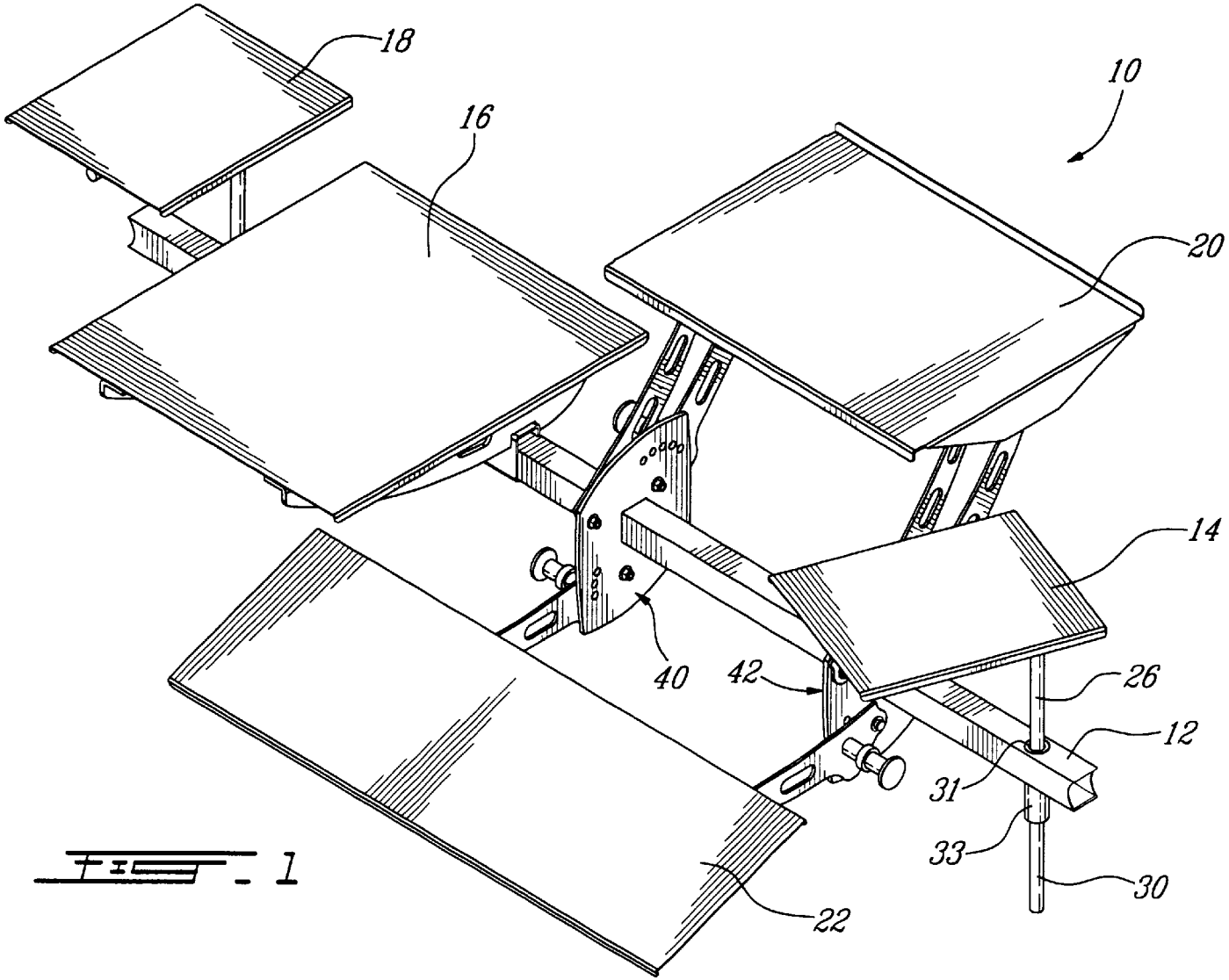
FIG. 1 is a perspective view illustrating a computer work station according to an embodiment of the present invention.

Turning now to the appended figures, a computer work station 10 according to an embodiment of the present invention will now be described.

The computer work station 10 includes a main longitudinal support 12, to which are mounted the other components of the assembly 10 as will be described hereinbelow. The main longitudinal support 12 has a generally square cross-section and is to be mounted to a ground engaging assembly, such as, for example legs (not shown) allowing the support 12 to be height adjustable.

The computer work station 10 also includes a mouse pad shelf 14, a printer shelf 16, a telephone shelf 18, a monitor shelf 20 and a keyboard shelf 22.

Figure 2:
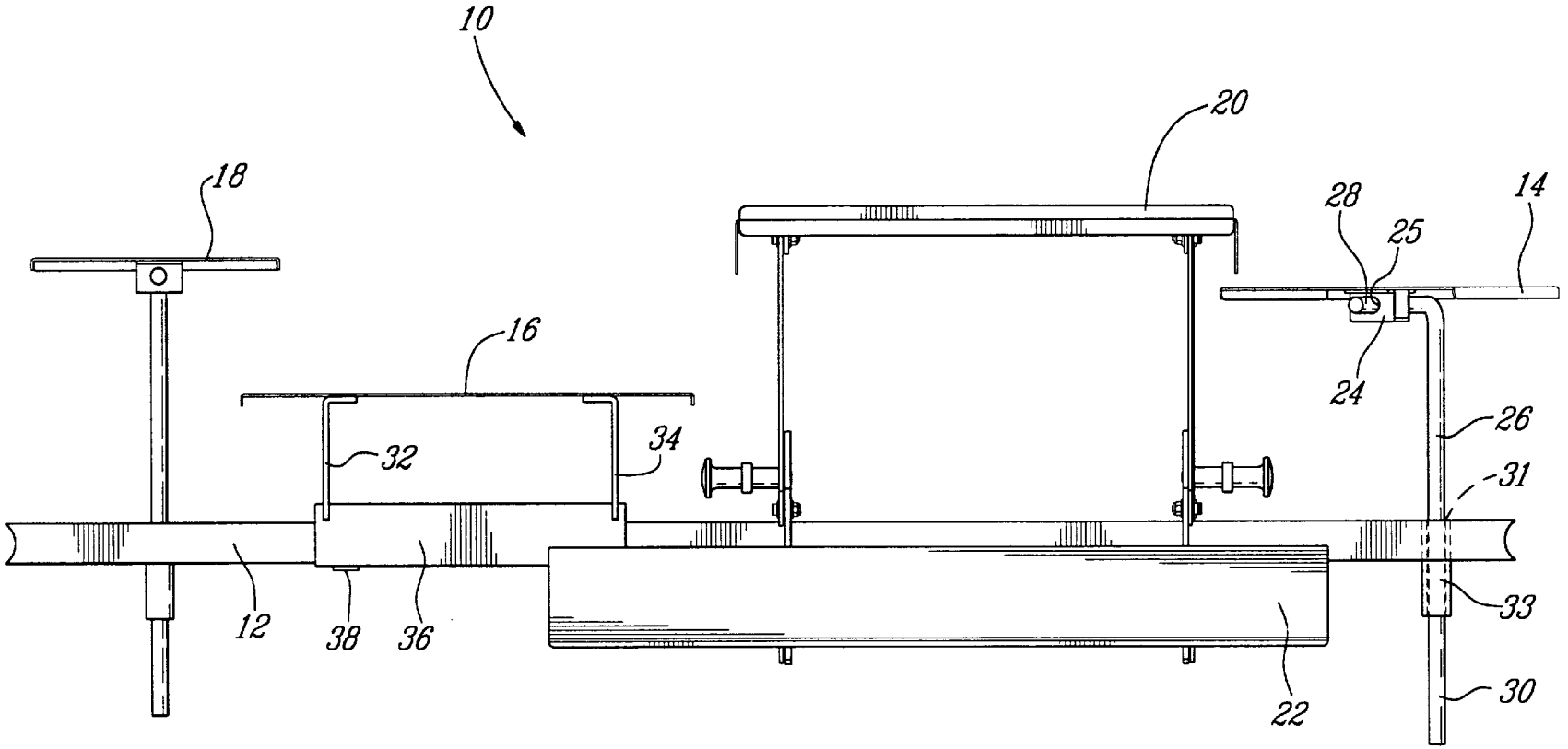
FIG. 2 is a front elevational view of the computer work station of FIG. 1.

Turning to FIG. 2 of the appended drawings, the mouse pad shelf 14 is generally rectangular and includes a bracket 24 provided with a circular aperture 25 provided therein. The mouse pad shelf 14 is mounted to the main support 12 via a L-shaped mounting rod 26. More specifically, the mounting rod 26 has a first end 28 slidably mounted in the aperture 25 of the bracket 24 and a second end 30 adjustably mounted in a circular aperture 31 of the main support 12. Fasteners (not shown) are provided to removably secure the ends 28 and 30 in their respective apertures 25 and 31 when the mouse pad shelf 14 is in its intended position. As can be better seen from FIG. 1 of the appended drawings, a sleeve 33 is fixedly mounted in the aperture 31 and has a central bore sized to receive the second end 30 of the mounting rod 26 therein. The sleeve 33 increases the contact surface between the rob 26 and the main support 12, thereby increasing the stability of the shelf 14. As will be apparent to one skilled in the art, the interconnections between the rod 26 and the circular apertures 25 and 31 allow the mouse pad shelf 14 to be moved up and down, back and forth, rotated about a generally vertical axis and rotated about a generally horizontal axis.

The telephone shelf 18 is identical in size and configuration to the mouse pad shelf 14 and will not be further discussed herein for concision purposes.

The printer shelf 16 includes two downwardly projecting arms 32 and 34 mounted to a tubular bracket 36 configured and sized to be slidably mounted to the main support 12. A pair of fasteners 38 (only one shown) are used to releasably secure the shelf 16 at a desired position with respect to the main support 12.

Figure 4:
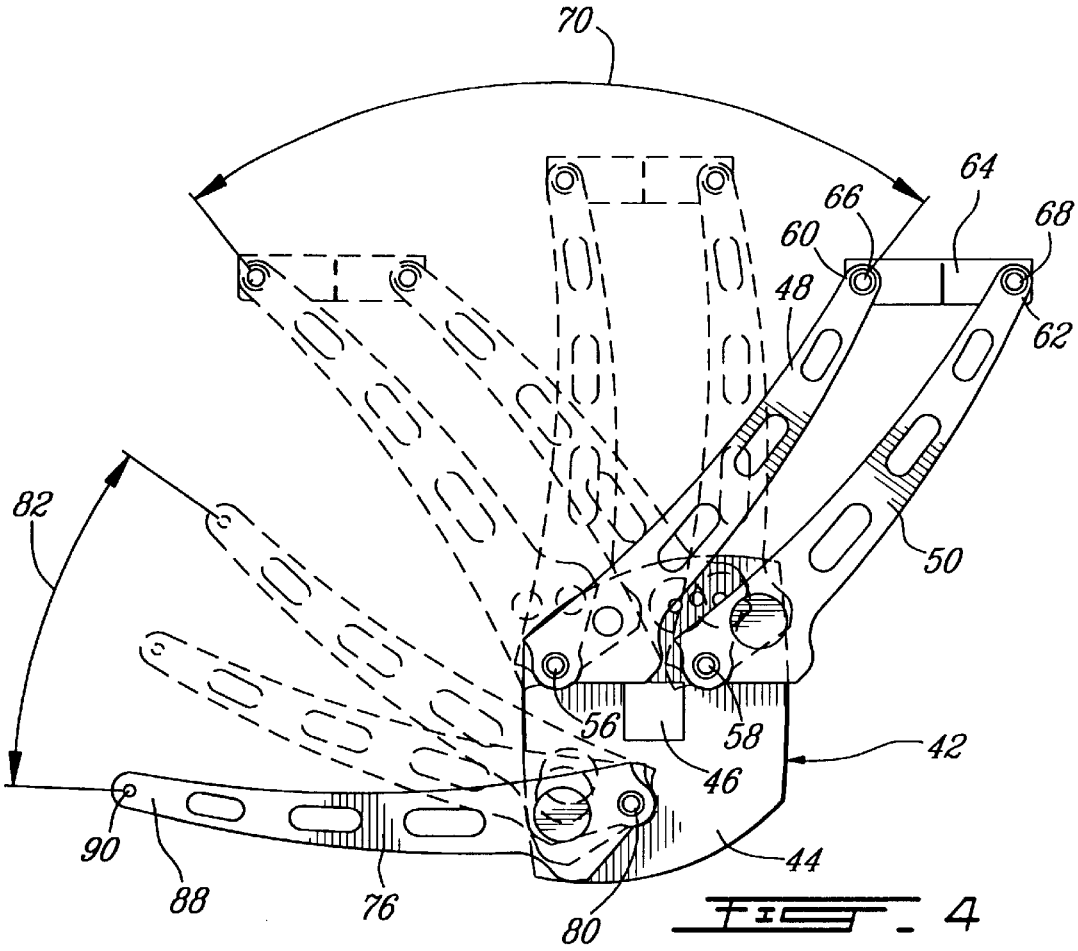
FIG. 4 is a side elevational view of a support element used to support the monitor shelf and the keyboard shelf of the computer work station of FIG. 1.
Figure 5:
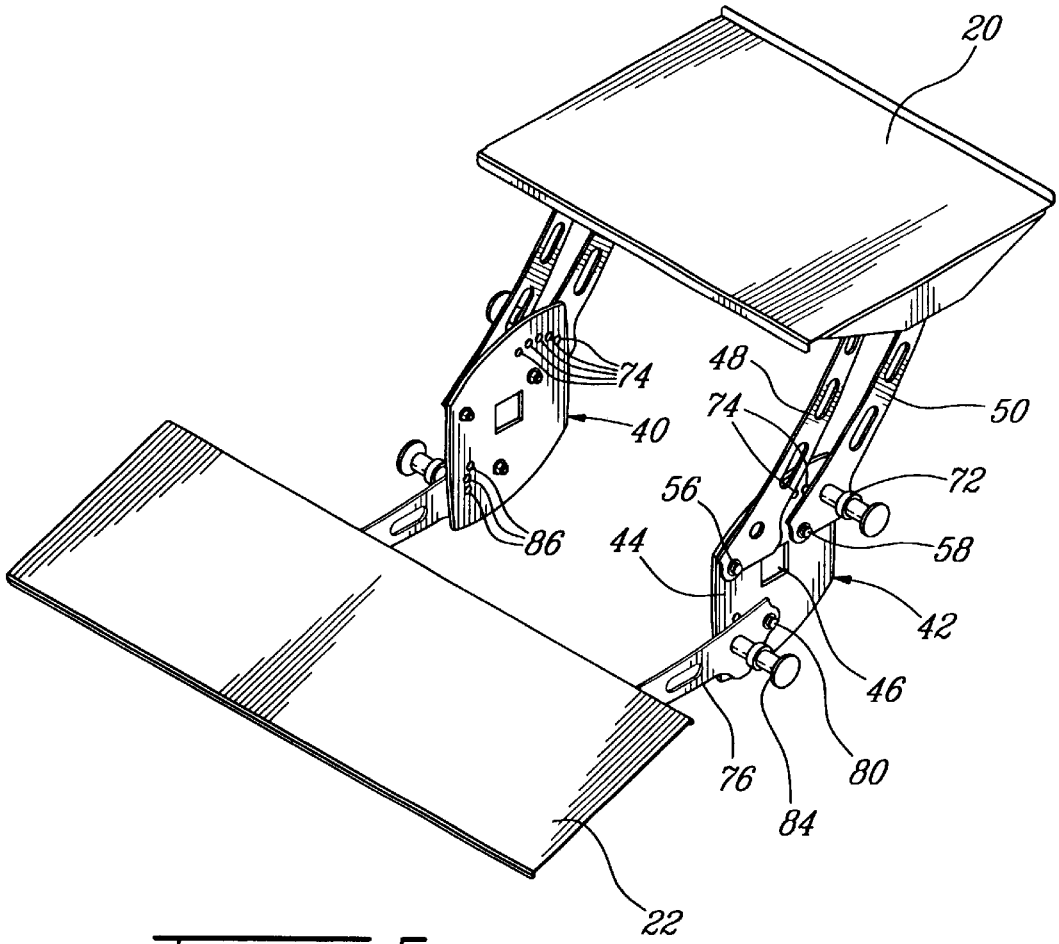
FIG. 5 is a perspective view of two support elements of FIG. 4 shown mounted to a monitor shelf and to a keyboard shelf.
Figure 6:
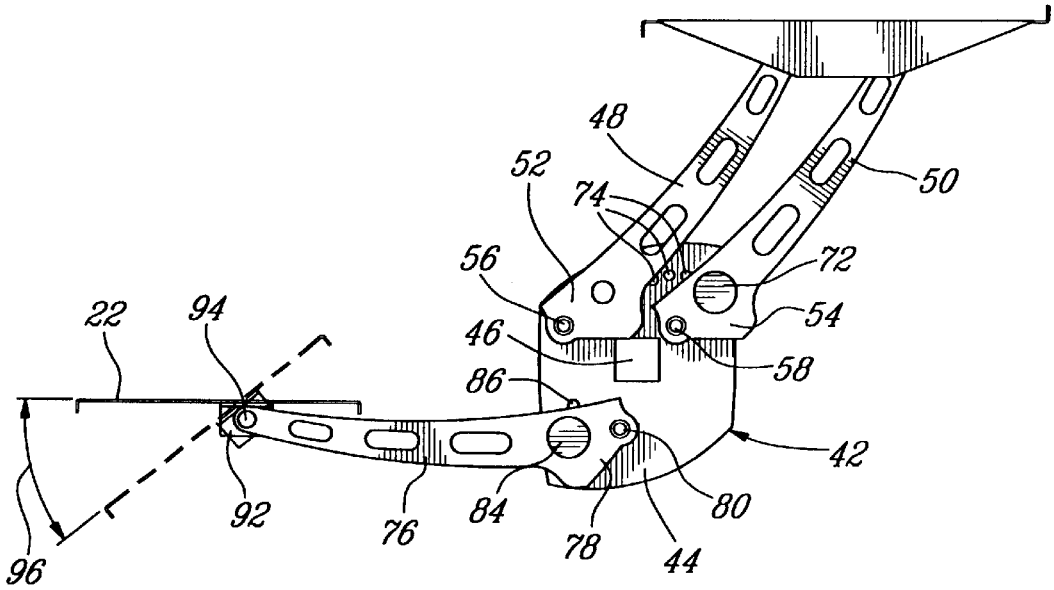
FIG. 6 is a side elevational view of FIG. 5.

The monitor shelf 20 and the keyboard shelf 22 are adjustably mounted to the main support 12 via a pair of adjustable support elements 40 and 42, as can be better seen from FIGS. 4 to 6.

For concision purposes, and since the supports 40 and 42 are very similar, only the adjustable support 42 will be described hereinafter.

Turning more specifically to FIG. 6 of the appended drawings, the adjustable support 42 includes a body 44 provided with a central aperture 46 configured and sized so that the support 42 may be slid onto the main support 12. The adjustable support 42 also includes a pair of parallel arms 48 and 50 having respective proximate ends 52 and 54 pivotally mounted to the body 44 via pivot pins 56 and 58. As can be better seen from FIG. 4 of the appended drawings, the arms 48 and 50 are also provided with respective distal ends 60 and 62 that are interconnected by a bracket 64. More specifically, the bracket 64 is pivotally mounted to both distal ends 60 and 62 via respective pivot pins 66 and 68. The bracket 64 is used to mount the monitor shelf 20 to the distal ends of the arms 48 and 50.

As will be easily understood by one skilled in the art, the pivotal movements of the parallel arms 48 and 50 about respective pivot pins 56 and 58 will cause the bracket 64 to move as shown by arrow 70 in FIG. 4 while maintaining the same attitude. It is therefore possible to move the monitor shelf 20 towards or away from the user while keeping it generally horizontal. Furthermore, by moving the monitor shelf 20 toward or away from the user, the vertical position, i.e., the height of the monitor shelf 20 with respect to the main support 12, is adjusted, as can be seen in FIG. 4.

The adjustable support 42 also includes a monitor shelf locking mechanism to maintain the monitor shelf 20 in a preferred position. This mechanism consists of a spring-loaded plunger 72 mounted to the arm 50 and a plurality of circular apertures 74, provided in the body 44, that are positioned and sized to receive the projecting end (not shown) of the plunger 72.

The apertures 74 are positioned along a radius following the radius of the plunger 72 when the arm 50 pivots about pivot pin 58. As can be better seen from the adjustable support 40 in FIG. 5, there are five apertures 74. Of course, this number could be changed without departing from the spirit and nature of the present invention. It is also to be noted that other locking mechanism (not shown) should be provided to maintain the monitor shelf 20 in a preferred position.

To modify the position of the monitor shelf 20, the user simply has to overcome the strength of the biasing element (not shown) of the spring-loaded plunger 72 through a pulling action to move the plunger 72 from its locked position to its unlocked position. The effect of such a pulling action is the removal of the projecting end of the plunger from one of the apertures 74. The user may then move the monitor shelf 20 in a desired position before allowing the projecting end to enter an aperture 74 corresponding to the desired position of the shelf 20.

It is to be noted that only three out of five possible positions of the parallel arms 48 and 50 are illustrated in FIG. 4.

Finally, the adjustable support 42 includes a pivotable arm 76 having a proximate end 78 pivotally mounted to the body 44 via a pivot pin 80 allowing the arm 76 to pivot as illustrated by arrow 82 in FIG. 4.

Again, the arm 76 includes a keyboard shelf locking mechanism to maintain a preferred position of the arm 76 and therefore of the keyboard shelf 22 as will be described hereinbelow. This mechanism consists of a spring loaded plunger 84 mounted to the arm 76 and a plurality of circular apertures 86 of the body 44 that are positioned and sized to receive the projecting end (not shown) of the plunger 84. The apertures 85 are positioned along a radius following the radius of the plunger 84 when the arm 74 pivots about pivot pin 80. As can be better seen from the adjustable support 40 in FIG. 5, there are three apertures 86. Of course, this number could be changed without departing from the spirit and nature of the present invention. It is also to be noted that other locking mechanism (not shown) should be provided to maintain the keyboard shelf 20 in a preferred position.

To modify the angular position of the keyboard shelf 22 with respect to the adjustable supports 40 and 42, the user simply has to overcome the strength of the biasing element (not shown) of the spring-loaded plunger 84 through a pulling action to move the plunger 84 from its locked position to its unlocked position. The effect of such a pulling action is the removal of the projecting end of the plunger from one of the apertures 86. The user may then move the keyboard shelf 22 in a desired position before allowing the projecting end to enter an aperture 86 corresponding to the desired position of the shelf 22.

As can be seen from FIG. 4, the distal end 88 of the arm 76 is provided with an aperture 90 to which a rod 94 (see FIG. 6) may be inserted. More specifically, the rod 94 includes a first end inserted in the aperture 90 of the adjustable support 42 and a second end inserted in the corresponding aperture 90 of the adjustable support 40, thereby linking the two corresponding arms 76.

Figure 3:
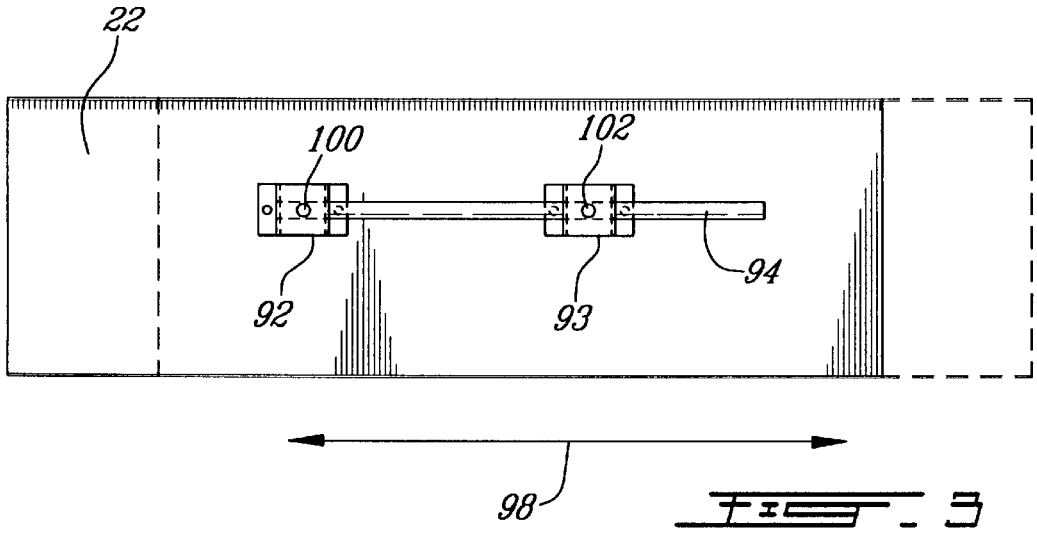
FIG. 3 is a bottom plan view of the keyboard shelf of the computer work station of FIG. 1.

The keyboard shelf 22 includes two brackets 92 and 93 (see FIG. 3) including an aperture (not shown) allowing the brackets to be mounted to the rod 94. This allows the keyboard shelf 22 to be pivoted about pivot rod 94 as illustrated by arrow 96 in FIG. 6. It also allows the keyboard shelf 22 to be slid onto the rod 94 to thereby laterally move the shelf 22 as illustrated by arrow 98 in FIG. 3.

It is to be noted that each bracket 92 and 93 respectively includes a fastener 100 and 102 that may be manually actuated by the user to maintain the keyboard shelf 22 in a desired position.

As will easily be understood by one skilled in the art, the computer stand according to the present invention presents many advantages over the conventional computer stand of the prior art. For example, the fact that every shelf is connected to the main longitudinal support 12 is advantageous since it allows the use of conventional legs (not shown).

Another advantage of the computer stand of the present invention is the ease of modification of the position of the monitor and keyboard shelf.

It is to be noted that while the present invention has been described hereinabove as being a computer work station, it could be used as a play station since the various shelves described herein could support the various peripherals used in play stations such as, for example, a TV/monitor, a game controller and a joystick.

Although the present invention has been described hereinabove by way of preferred embodiments thereof, it can be modified, without departing from the spirit and nature of the subject invention as defined in the appended claims.

What is claimed is:

1. A computer work station comprising:

a generally longitudinal main support;

first and second adjustable support elements mounted to said generally longitudinal main support; each said first and second adjustable support element including a body, a pair of parallel arms having proximate ends pivotally mounted to said body and distal ends, and a third arm having a proximate end pivotally mounted to said body and a distal end; said first and second adjustable support elements being so mounted to said generally longitudinal main support as to be longitudinally slidable thereon;

a monitor shelf pivotally mounted to said distal ends of said pair of parallel arms; and a keyboard shelf pivotally mounted to said distal end of said third arm.

2. A computer work station as recited in claim 1, wherein at least one of said first and second adjustable support includes a monitor shelf locking mechanism.

3. A computer work station as recited in claim 2, wherein said monitor shelf locking mechanism is so mounted to one of said parallel arms as to selectively prevent pivotal movements of said parallel arms with respect to said body.

4. A computer work station as recited in claim 3, wherein said monitor shelf locking mechanism includes a plunger mounted to one of the parallel arms and at least two apertures provided in said body; said plunger including a projecting end configured and sized to selectively enter said apertures to thereby prevent further pivoting action of said one of said parallel arms; said plunger being reciprocately movable between a locked position where it enters one of said at least two apertures and an unlocked position.

5. A computer work station as recited in claim 4, wherein said plunger includes a biasing element biasing said plunger towards said locked position.

6. A computer work station as recited in claim 1, wherein at least one of said first and second adjustable support includes a keyboard shelf locking mechanism.

7. A computer work station as recited in claim 6, wherein said keyboard shelf locking mechanism is so mounted to said third arm as to selectively prevent pivotal movements of said third arm with respect to said body.

8. A computer work station as recited in claim 7, wherein said keyboard shelf locking mechanism includes a plunger mounted to said third arm and at least two apertures provided in said body; said plunger including a projecting end configured and sized to selectively enter said apertures to thereby prevent further pivoting action of said third arm; said plunger being reciprocately movable between a locked position where it enters one of said at least two apertures and an unlocked position.

9. A computer work station as recited in claim 8, wherein said plunger includes a biasing element biasing said plunger towards said locked position.

10. A computer work station as recited in claim 1, further comprising a supplemental shelf mounted to said main support.

11. A computer work station as recited in claim 10, wherein a) said supplemental shelf includes a bracket provided with a circular aperture, b) said main support includes a circular aperture, and c) said supplemental shelf includes an L-shaped mounting rod having a circular cross-section and first and second ends; wherein said first end is slidably mountable in said circular aperture of said bracket and said second end is slidably mountable in said circular aperture of said main support.

12. A computer work station as recited in claim 1, further comprising a printer shelf provided with a tubular bracket configured and sized to be slidably mounted to said main support.

13. A computer work station comprising:

a longitudinal supporting means;

a monitor shelf pivotally mounted to said longitudinal supporting means;

a keyboard shelf pivotally mounted to said longitudinal supporting means; and first and second adjustable supports so mounted to said longitudinal supporting means as to be longitudinally slidable thereon; each said first and second adjustable supporting means including a body, a pair of parallel arms each having a proximate end pivotally mounted to said body and a distal end for receiving said monitor shelf, and a third arm having a proximate end pivotally mounted to said body and a distal end for receiving said keyboard shelf.

* * * * *